United States Patent [19]

Waugh et al.

[11] 3,949,576

[45] Apr. 13, 1976

[54] LIQUID FLOW DIVERSION ARRANGEMENT

[75] Inventors: Richard A. Waugh; Ved P. Gakhar, both of Louisville, Ky.

[73] Assignee: General Electric Company, Louisville, Ky.

[22] Filed: Apr. 21, 1975

[21] Appl. No.: 569,984

Related U.S. Application Data

[62] Division of Ser. No. 406,535, Oct. 15, 1973, Pat. No. 3,897,806.

[52] U.S. Cl. ..... 68/12 R; 68/17 R; 68/207; 137/832

[51] Int. Cl.[2] ..... D06F 39/02

[58] Field of Search ..... 68/12 R, 17 R, 207; 134/93; 137/806, 825, 832, 836, 837, 841

[56] References Cited

UNITED STATES PATENTS

| | | | |
|---|---|---|---|
| 3,373,905 | 3/1968 | Laufer | 137/806 X |
| 3,401,834 | 9/1968 | Siegla | 222/62 |
| 3,441,066 | 4/1969 | Wilhire | 137/832 X |
| 3,513,866 | 5/1970 | Boothe et al. | 137/81.5 |
| 3,527,240 | 9/1970 | Metzger | 137/836 X |
| 3,575,210 | 4/1971 | Fussell | 137/806 X |
| 3,670,754 | 6/1972 | Freeman | 137/836 X |
| 3,727,434 | 4/1973 | Bochan | 68/17 R |
| 3,760,612 | 9/1973 | Bochan et al. | 68/17 R |

*Primary Examiner*—Stanley N. Gilreath
*Assistant Examiner*—Philip R. Coe
*Attorney, Agent, or Firm*—Fredrick P. Weidner; Francis H. Boos

[57] ABSTRACT

An improved liquid flow diversion arrangement for use with an additive dispensing system in an automatic washer. Included is a liquid flow diverter of the transverse pressure differential type having control ports coupled to atmosphere by tubes whose open ends terminate at the machine sequence control timer. Means are provided associated with the timer for closing the open ends of the tubes and thereby the control ports at predetermined times to effect liquid flow diversion. A check valve is provided at the outer end of each control port for preventing liquid from escaping from the fluid diverter. A chamber is coupled by a segment of the tubing between each control port and the timer for accumulating liquid that may bypass the check valves and further, for preventing audible sonic oscillations which may occur in the liquid flow diversion arrangements due to the inherent ability of the diverter to amplify resonance in the system. Coupled to the respective chambers at the bottoms thereof are a pair of hoses for draining liquid accumulating in the chamber, the hoses being dimensioned to act as closed valves with respect to the control ports while at the same time allowing liquid to drain automatically from the chamber when a sufficient head has been built up therein.

5 Claims, 5 Drawing Figures

LIQUID FLOW DIVERSION ARRANGEMENT

CROSS-REFERENCE TO RELATED APPLICATION

This application is a division of copending patent application Ser. No. 406,535 for "Liquid Flow Diversion Arrangement," filed Oct. 15, 1973, in the names of Richard A. Waugh and Ved P. Gakhar, and assigned to the assignee of this application, and now U.S. Pat. No. 3,897,806.

BACKGROUND OF THE INVENTION

1. Field of the Invention

The present invention relates to a liquid flow diversion arrangement and more particularly, to an automatic washer having an additive dispensing system including a multi-compartmented dispenser making use of such a liquid flow diversion arrangement for flushing additives from the dispenser into the washer at predetermined times during a washing cycle.

2. Description of the Prior Art

In an automatic washing machine, it is desirable that additives be dispensed automatically. When the dispensing of additives is automatic, the user may load the fabrics to be washed into the wash tub and place the additives into their proper compartments or containers, and the machine automatically completes the cycle of operations. Better results are obtained if these various additives are dispensed with water so that the additives are metered into the wash tub and evenly distributed therethrough. In U.S. Pat. Nos. 3,727,434-Bochan and 3,760,612-Bochan et al., both assigned to the same assignee as the present invention, there are shown automatic washers for carrying out such operations. Additive dispensing systems are disclosed therein which make use of a liquid flow diverter for supplying water to the appropriate compartments of an additive dispenser such that additives may be dispensed into the washing machine automatically during the appropriate portion of the washing cycle. Prior art as in U.S. Pat. No. 3,513,866-Boothe et al., also assigned to the same assignee as the present invention, shows a fluid amplifier or liquid flow diverter for selectively diverting a stream of water for dispensing additives from separate compartments into the wash tub of an automatic washing machine.

Since it is desirable that the liquid flow diverter be responsive to a sequence control timer to selectively divert a water stream to the appropriate dispenser compartments at predetermined times during a washing cycle, it has been found advantageous to couple the respective control ports of such a liquid diverter with a sequence control timer through a pair of tubes. Also, since diversion of water by the diverter is accomplished as a result of transverse pressure differential effected by closing alternate control ports to atmosphere, it has been found that the closing of these control ports may be advantageously effected by means associated with the timer which will cause the closing of the tubes associated with the respective control ports.

In one diverter arrangement, a check valve is provided associated with each control port for preventing the emergence of liquid from the respective control ports resulting from foreign materials plugging the diverter efflux nozzle. Also, a chamber is coupled respectively between each control port and its respective closing means for accumulating liquid that may bypass the check valves, the chamber being dimensioned for preventing audible sonic oscillations in the liquid flow diversion arrangement arising from the inherent ability of the diverter to amplify resonance in the system.

A problem then arises, what to do about liquid accumulating in the respective chambers. If the liquid is not drained therefrom, the chambers will overfill and liquid will flow through the respective tubes eventually to pour out into the control compartment resulting in incapacitation of the automatic washer.

It is highly desirable to be able to drain the accumulating chambers automatically, yet have an arrangement that does not adversely affect the operation of the control ports.

By the present invention, there is provided an improved liquid flow diversion arrangement that provides these desirable characteristics and is highly reliable, efficient and of low cost.

SUMMARY OF THE INVENTION

In accordance with the present invention, there is provided a liquid flow diversion arrangement including a liquid diverter. The diverter has a main inlet for liquid to enter, a liquid outlet providing a plurality of exit paths for the liquid, and at least one control port coupled to ambient. The arrangement further includes means for selectively closing the control port from ambient for determining through which exit path liquid entering the main inlet will emerge. Means are provided coupled between the control port and its closing means for accumulating liquid emerging from the control port, the accumulating means being dimensioned for preventing audible sonic oscillations in the liquid flow diversion arrangement. Means are provided associated with the accumulating means for draining liquid accumulating therein, the draining means being dimensioned to act as a closed valve with respect to the control port, while allowing liquid to drain automatically from the accumulating means when a sufficient head has been built up therein. If more than one control port is employed, then each would have its respective closing means and preventing means.

It is an object of the present invention to provide a liquid flow diversion arrangement which provides means for automatically draining therefrom liquid that may accumulate therein.

It is a further object to provide, in an automatic washer including an additive dispensing system, a liquid flow diversion arrangement capable of selectively diverting liquid into pre-selected dispenser compartments at predetermined times while allowing liquid that may accumulate in the diversion arrangements to drain automatically therefrom so as to prevent liquid that may back up in the diverter from reaching the electrical components of the automatic washer.

DESCRIPTION OF THE PREFERRED EMBODIMENT

Figure 1:
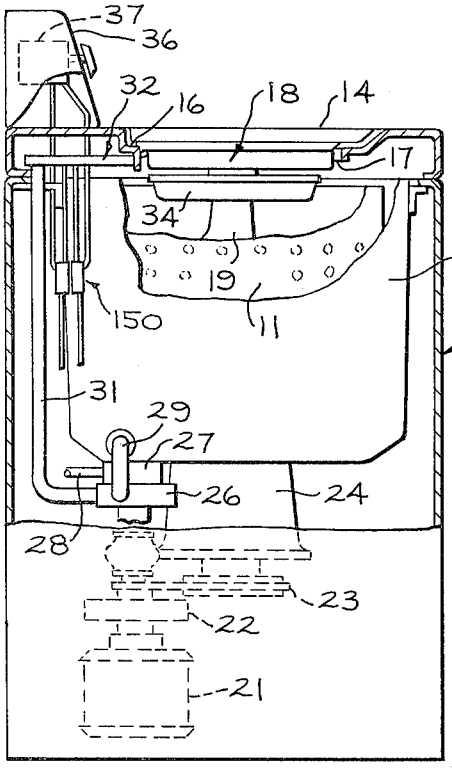
FIG. 1 is a side elevational view of an automatic clothes washing machine incorporating one embodiment of my invention, the view being partly broken away and partly in section.

Referring now to FIG. 1, we have shown therein an automatic washing machine of the vertical axis type having a conventional perforated wash tub or basket 11 disposed within an outer imperforate liquid retaining outer tub 12. With this combination, the tubs 11 and 12 form suitable means for containing liquid and the fabrics to be washed in said liquid. The outer tub 12 is rigidly mounted within an appearance cabinet 13 which includes an access lid or cover 14 hingedly mounted on a hinge rod 16 on the top portion of the cabinet for providing access through an opening 17 to the basket 11.

Shown positioned over the tub 11 and projecting into the opening 17 is a wash water treating agent dispenser 18 which forms a portion of the additive dispensing system. Such a system may be of the type described in U.S. Pat. Nos. 3,727,434-Bochan and 3,760,612-Bochan et al., both assigned to the same assignee as the present invention. Preferably this is effected by removably and hingedly mounting the dispenser 18 to the underside of the access lid by suitable means to be described hereinafter in detail. At the center of the wash tub 11 there is positioned an agitator 19 for flexing clothes during a washing operation. Conventionally, the basket is mounted for rotation and the agitator is mounted for some type of oscillatory motion which will effect washing action on the clothes in the basket.

Basket 11 and agitator 19 are driven from a reversible motor 21 through a drive including a clutch 22 which through a suitable belt 23 transmits power to a transmission 24. When the motor 21 is rotated in one direction the transmission causes a slow speed oscillation of the agitator 19. Conversely, when the motor is driven in the opposite direction the transmission drives both basket and agitator at a high speed for centrifugal extraction of the liquid from the clothes. While the particular form of the drive means does not form a part of the present invention, reference is made to U.S. Pat. No. 2,844,225 to James R. Hubbard et al., assigned to General Electric Company, assignee of the present invention.

In addition to operating the transmission 24 as described, motor 21 also provides a direct drive to a pump structure which includes separate pumping units 26 and 27. During the high speed operation pump 27 draws liquid from the outer tub 12 and discharges it through conduit 28. During wash or slow speed the pump 26 draws liquid in through conduit 29 and discharges through conduit 31. Conduit 31 extends up to and terminates at a fluid amplifier or liquid flow diverter 32, which will hereinafter be described in detail. The diverter 32 is fixedly mounted on the cabinet top and has its outlet end 33 arranged to cooperate selectively with suitable inlets in the dispenser 18 and the filter pan 34 in a manner that will be disclosed later in the description of the operation of the present invention. Mounted on the cabinet 13 is a control compartment 36 in which are located control devices, including a cycle controller or sequence control timer 37 which conducts the washing machine and the diverter 32 through various cycles of operation.

Figure 2:
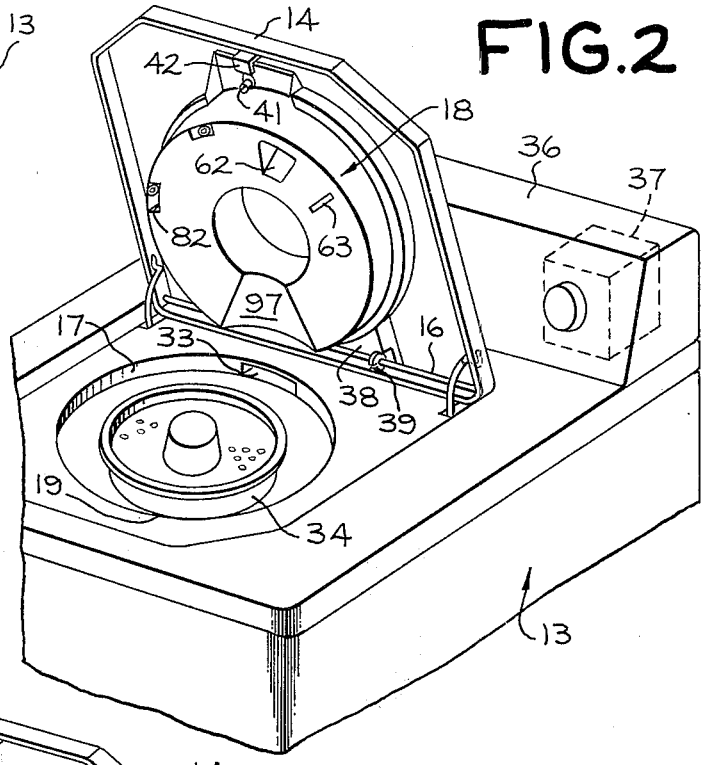
FIG. 2 is a perspective view showing an additive dispensing system incorporating the liquid flow diversion arrangement of the present invention, in one form thereof.
Figure 3:
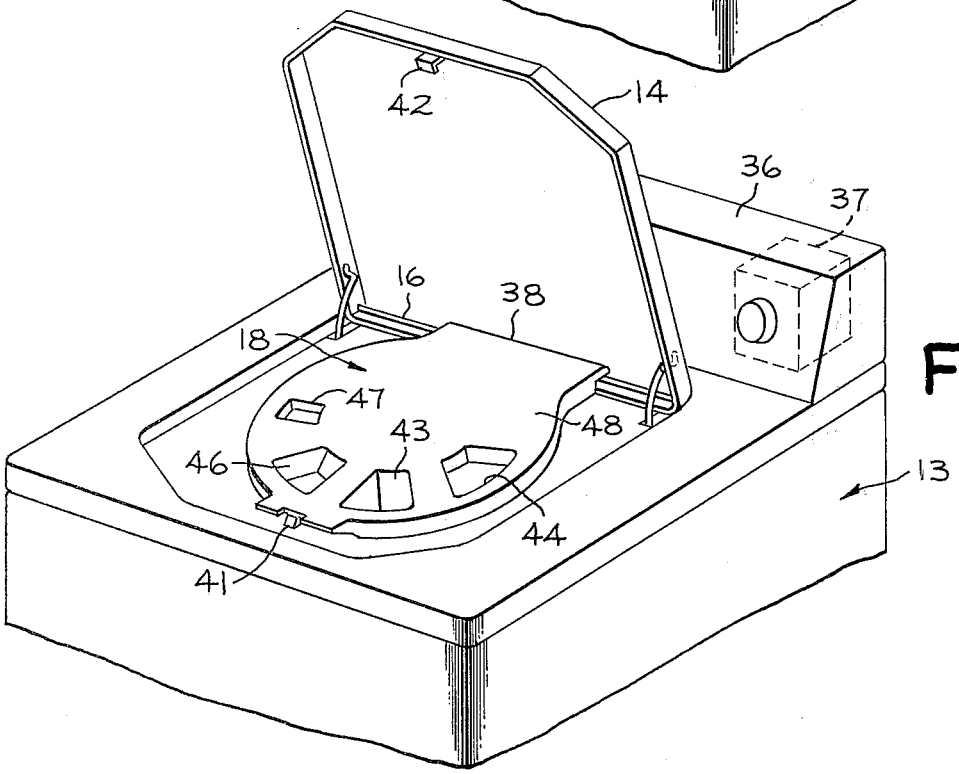
FIG. 3 is a perspective view showing the additive dispensing system in a treating agent loading position.

Referring now to FIGS. 2 and 3 of the drawing there is shown dispenser 18 wherein a straight portion 38 is provided with a pair of bifurcated ears 39 (FIGS. 4 and 9) formed integral with the dispenser. The ears 39 engage the rod 16 which has its free ends suitably journalled through the access lid 14 and into the cabinet top. Ears 39 and rod 16 form a hinge about which the dispenser may be rotated independent of the access lid 14. The bifurcated ears 39 are dimensioned to allow the removal of the dispenser 18 from the machine when it is desirable not to dispense additives automatically or for easy cleaning of the dispenser away from the washing machine.

Diametrically opposite the portion 38 there is provided a latch member 41 which is adapted to engage a keeper or bracket 42 on the cover 14 for holding the dispenser in the latched position shown in FIG. 2. In this up or latched position the dispenser rotates with the lid 14 to an open position away from the opening 17 thereby exposing the wash tub 11 to the user for insertion of fabrics to be washed and for their removal at the end of the wash operation.

In order to provide access to the tub 11 and the fabrics therein whenever the lid is rotated to its open position, it is desirable to have the dispenser 18 rotate with the lid. To insure that the dispenser is latched to the access lid prior to rotating the lid to its open position the relationship of the machine cabinet top, access lid 14 and dispenser 18 may be designed such that the latch 41 and keeper 42 automatically engage when the access lid 14 is rotated to its closed position over the dispenser 18.

Figures 4, 5:
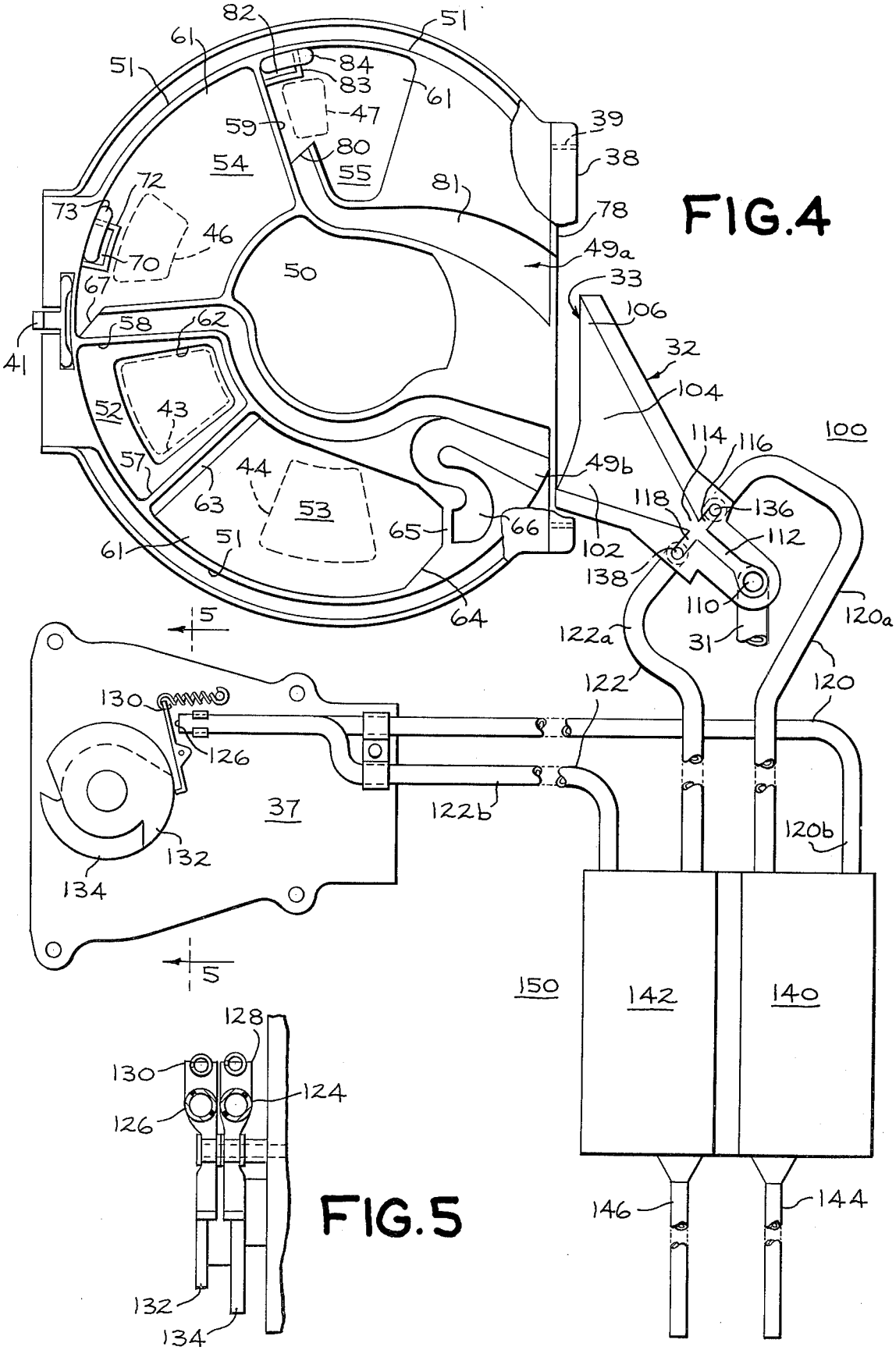
FIG. 4 is a view of the liquid flow diversion arrangement of the present invention showing in section the liquid diverter and the additive dispenser which may be associated therewith.
FIG. 5 is a sectional view taken generally along the lines 5—5 of FIG. 4.

Subsequent to filling the wash tub 11 with fabrics to be washed and the determination is made to automatically dispense one or more treating agents into the machine tub the dispenser 18 may then be unlatched and rotated to the position shown in FIG. 3. In this down or effective position the dispenser is accessible to the user of the machine for selectively inserting treating agents to be automatically dispensed during the washing operation into one or all of a plurality of openings 43, 44, 46 and 47 provided in the cover member 48 of the dispenser 18. The openings 43, 44, 46 and 47 are defined by funnel-like inwardly and downwardly projecting wall portions that facilitate the introduction of treating agents therethrough. Generally a prewash or soak agent may be placed in opening 43 to be effective during the prewash or soak cycle of the wash operation, a detergent or washing agent may be placed in opening 44 and a bleach may be placed in opening 46 to be dispensed during the washing cycle of the wash operation while a rinse agent may be placed in opening 47 to be dispensed during the rinse cycle of the wash operation. Referring now to FIG. 4, the dispenser is shown with the cover 48 removed therefrom to expose details of construction. The dispenser 18 as shown is generally an annularly-shaped segmented channel or trough defined by annular inner and outer walls 50 and 51 respectively. The outer wall 51 is generally imperforate except for inlets **49*a* and 49*b* located below portion 38 as to be in cooperative relationship with the outlet 33 of the diverter 32 when the dispenser 18 is in its effective position as shown in FIGS. 1 and 3. The dispenser 18 is divided into four annular compartments 52, 53, 54 and 55 by a series of radial walls 57, 58 and 59 which project upwardly from a bottom wall 61 to the cover 48 and extend from the inner wall 50 to the outer wall 51. The openings 43, 44, 46 and 47 in the cover 48 as shown in dotted lines communicate with the compartments 52, 53, 54 and 55 respectively so that presoak agents placed in opening 43 pass through compartment 52, detergent placed into opening 44 is stored in compartment 53, bleach placed into opening 46 is stored in compartment 54 and rinse agent placed into opening 47 is stored in compartment 55.**

Unlike compartments 53, 54 and 55, compartment 52 is not designed to store a treating agent but merely provides a passageway for introducing prewash liquid treating agents directly into the tub 11 or into filter pan 34 to be effective during the first fill cycle of the machine. To this end the bottom wall portion of the compartment 52 has an opening 62 which is larger than the corresponding opening 43 in the cover 48 to facilitate easy dispensing of the prewash agent. Further, the opening is so located as to be directly over the filter pan 34, thus, if it is desired, the prewash agent may be dispensed from the filter pan as will hereafter be explained.

Detergent or soap to be dispensed from compartment 53 during the wash cycle is usually in solid, granular, or high viscosity water soluble form. The bottom wall 61 is provided with a discharge outlet or opening 63 adjacent the lower end of wall 57 and extending across substantially the entire width of the wall 57. At the opposite end of the compartment 53 from wall 57, there is provided an ingress wall 64 which has an opening 65 along the bottom wall 61. Opening 65 is connected to the inlet area **49*b* by a passageway 66. The detergent or soap powder entering the compartment 53 will arrange itself in a pile substantially across the full width of bottom wall 61. The opening 65 is so dimensioned that water entering therethrough is directed in a fan-like stream over the full width of the bottom wall. This shallow, relatively high velocity discharge from opening 65 will encounter the dry powder to undercut and intermix thoroughly therewith to effectively convey it along the bottom wall into outlet 63 and thence into tub 11. In practice, the flow of liquid through opening 65** continues after the powder has been evacuated, so there is no substantial residue within the chamber.

Bleach stored in compartment 54 is dispensed during the wash cycle subsequent to the dispensing of the detergent in a manner that will hereinafter be described in detail. Compartment 54 is defined by walls 50, 51, 58 and 59. Extending into compartment 54 along walls 50 and 58 is the outlet end 67 of a channel or passageway 68. Passageway 68 is located adjacent the cover 48 and connects the compartment 54 with the inlet area **49*b*. Located in the bottom wall 61 adjacent the outer wall 51 is a discharge outlet 70 through which the bleach stored in the compartment 54 is introduced into the tub 11. Bleach stored in the compartment 54 may be liquid and concentrated in form. In order to prevent liquid from draining into the tub prematurely, a wall or barrier 72 is located around the discharge outlet 70 in a manner that is effective to isolate compartment 54 from outlet 70. When the bleach is in concentrated form, the barrier allows mixing of the bleach stored in the compartment with water entering through outlet 67 and the mixture must rise above the top of barrier 72 before liquid can pass through opening 70.** The flow of water entering the compartment from the passageway is metered in a manner to be described hereinafter.

Provision is made to drain the compartment 54 when the water flow from outlet 67 terminates. A siphon 73 has its short leg 74 positioned within the chamber 54 and extending to a point adjacent the bottom wall 61. The longer leg 75 of the siphon 73 extends down outside of the barrier 72 and is positioned within the outlet 70. The top or curved portion 76 of the siphon passes through the barrier 72 at a point below which the liquid drains over the barrier.

When the mixture reaches a level that it drains over the barrier 72, it has also reached the top of the siphon at which point siphoning action starts with liquid draining through the siphon and through outlet 70. It will be observed that this action of draining through the siphon and outlet 70 will continue until the water entering the compartment 54 through outlet 67 terminates and then the mixture of bleach and water in the compartment will continue to flow out through the siphon until the chamber is emptied.

Rinse agent which is dispensed during the rinse cycle is stored in compartment 55 which is defined by walls 50, 51, 59 and a wall portion 78 opposite wall 59. Extending into compartment 55 along the wall 50 and 59 is the outlet end 80 of a trough or passageway 81. The passageway 81 is located adjacent the cover 48 and connects compartment 55 with inlet area **49*a*. The provision for mixing rinse aid with water entering the compartment 55 and for draining the mixture from said compartment is similar to the arrangement provided in compartment 54. A discharge outlet 82 in the bottom wall 61 is isolated from the compartment 55 by a wall or barrier 83 and a siphon tube 84 is disposed to connect the compartment 55 with the outlet 82.**

Provision is made so that additives or treating agents stored in the compartments 53, 54 and 55 are retained in the dispenser 18 in the event it is inadvertently or prematurely rotated to its up position prior to the dispensing of all the additives. In compartments 54 and 55 when the contents stored therein may be in liquid form the openings 46 and 47 in the cover 48 are so located in relation to the compartment walls that a substantial retention area is provided together with cover 48 to trap the contents. Provision is also made to prevent the contents of compartments 54 and 55 from discharging through the respective passageways 68 and 81. The outlet ends 67 and 80 of the passageways 68 and 81 are located in the area of the compartments 54 and 55 away from the hinge end of the dispenser 18 so as to be disposed above the retention area when the dispenser is in its up position. In compartment 53 the passageway 65 between the inlet **49*b* and the opening 66 has a U-shaped portion adjacent the opening 66 that is effective in trapping any wetted detergent from discharging through inlet 49*b*.**

In accordance with the present invention, improved means for diverting fresh or recirculation flow in an automatic washer into pre-selected ones of the dispenser inlet areas **49*a* and 49*b* and thereby into the appropriate dispenser compartments are provided. Referring to FIG. 4, there is shown an embodiment of a liquid flow diversion arrangement 100 which is capable of providing recirculating liquid such as water from the tub 11 selectively in a plurality of exit paths such as to the three outlet areas 102, 104 and 106 of diverter 32. The liquid flow diverter 32 is provided with a main inlet 110 which is connected to conduit 31. A main passage 112 is formed in the diverter connecting the main inlet 110 to a liquid outlet or efflux nozzle 114.**

The passage 112 is terminated adjacent a pair of diametrically-opposed control ports 116 and 118 which are coupled respectively to ambient or atmosphere through a pair of tubes 120 and 122 respectively.

Means are provided for selectively closing each of the control ports respectively from atmosphere for determining through which of the exit paths or areas 102, 104 and 106 liquid entering the main inlet 110 will emerge. The tubes 120 and 122 are secured to the timer 37 such that the open ends or passages 124 and 126 respectively of tubes 120 and 122 are positioned to cooperate with the free ends of a pair of pivotally mounted arms 128 and 130 respectively (FIG. 5). In operation, a cam 132 responsive to operation of timer 37 is arranged to rotate arm 130 about its pivot away from or toward the passage 126 of tubing 122 to open or close it to atmosphere, while a cam 134 also responsive to operation of timer 37 is arranged to rotate arm 128 about its pivot away or toward the passage 124 of tube 120 to open or close it to atmosphere.

The cams 132 and 134 may be actuated at predetermined times in the wash operation to selectively open and close passages 124 and 126 and thereby control ports 116 and 118 to atmosphere. During the pre-wash operation, the cams 132 and 134 are positioned to keep both passages 124 and 126 open to atmosphere and, since there is no transverse pressure differential across the stream of recirculating water flowing through main passge 112, the water will exit in a path to flow generally across area 104. During the rinse operation, the timer 37 actuates the cam 134 to close passage 124 and the transverse pressure differential created across the stream of water flowing through passage 112 will cause it to exit in a path to flow generally in area 106 of diverter 32. During the wash operation, the cam 132 is actuated by timer 37 to close passage 126, and the transverse pressure differential across the stream of water flowing through passage 112 will cause it to exit in a path to flow generally across area 102 of diverter 32.

Means for preventing liquid emergence such as a pair of ball check valves 136 and 138 have been inserted at the outer ends of control ports 116 and 118 respectively. Tubes 120 and 122 are then coupled respectively to the exposed open ends of check valves 136 and 138. In the event that any foreign material becomes lodged in efflux nozzle 114 of the diverter, any back flow through control ports 116 and 118 will cause check valves 136 and 138 respectively to seal to substantially stop the flow of water from reaching timer 37 and control compartment 36.

Means such as a pair of chambers 140 and 142 have been provided coupled respectively between control ports 116 and 118 and their respective closing means or arms 128 and 130. Chambers 140 and 142 are arranged for accumulating liquid such as water that may bypass check valves 136 and 138 respectively and are further dimensioned for preventing audible sonic oscillations in liquid flow diversion arrangement 100. When audible sonic oscillations are witnessed they can be eliminated by changing the relative dimensions of the chambers to the dimensions of the tubes. Tubes 120 and 122 have been cut into portions **120*a* and 120*b* and 122*a* and 122*b* respectively to allow the interposition or insertion of chambers 140 and 142** respectively.

It has been found that a chamber of relatively large volume with respect to the coupling tubes tends to lower the frequency of oscillation below the minimum operating range of the diverter thereby eliminating audible sonic oscillations. However, a point to be considered is the length of tube from the control port of the diverter to the chamber. If the tubes are long enough, they may ignore the chambers and start oscillation, therefore, this length at high water level in the washer should be short enough so that it has no oscillatory effect of its own when coupled with the chamber. On the other hand, at lower water levels in the washer, the length of tube from the diverter control port to the chamber should be long enough to prevent very low frequency oscillations from starting.

To solve the problem arising when water accumulates in the respective chambers 140 and 142, means are provided for draining chambers 140 and 142 periodically and automatically so that they may not overfill thereby allowing water to escape to flow into control panel 36. A pair of drain hoses 144 and 146 have been provided to effect the draining of chambers 140 and 142 respectively. The length and diameter of hoses 144 and 146 have been carefully selected so that the head loss of the respective hoses when using air as the flowing medium is great enough so as to limit the air flow to a quantity less than that required to replenish the air loss in the diverter control ports 116 and 118. In other words, the impedance presented by hoses 144 and 146 is very high so as to have substantially no effect upon control ports 116 and 118, in essence acting as closed valves with respect to the control ports.

Water however, having a greater density than air, has a lower head loss when used as the flowing medium in the same hose. Furthermore, by placing the hoses 144 and 146 in a vertical position, any water accumulated in chambers 140 and 142 will have a pressure differential due to gravity and will, upon building up a sufficient head, start to flow through hoses 144 and 146 and continue by siphoning action until the chambers are emptied.

An arrangement found suitable consists of a pair of chambers or tanks blow molded with a web between them so as to result in a single unit 150. Each tank has a pair of openings therein for attachment to tubes 120 and 122 and further, each tank has been provided with a drain hole at the bottom thereof for suitable attachment to drain hoses 144 and 146 respectively. Such a chamber or tank assembly 150 may be secured to the frame of the washing machine in close proximity to diverter 32 and drain hoses 144 and 146 are also suitably attached to the frame of the washer such that water flow therefrom may be aided by gravity (See FIG. 1).

Dimensions and values found suitable for such an arrangement include:

| | |
|---|---|
| Tanks 140 and 142 | 8 cu. in volume for each |
| Tubes 120a and 122a | ⅜" inside diameter by 7" long for each |
| Tubes 120b and 122b | ¼" inside diameter by 22" long for each |
| Hoses 144 and 146 | .060" inside diameter by 27" long for each |

It should be mentioned, that in an arrangement wherein suitable draining means are provided for the chambers 140 and 142, it is not necessary to provide control ports 116 and 118 with check valves such as 136 and 138. The check valves 136 and 138 are however, used in the preferred embodiment.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. In an automatic washer having a cycle control timer and an additive dispensing system including a multi-compartmented dispenser, a liquid flow diversion arrangement having a liquid diverter for selectively diverting liquid into preselected dispenser compartments for flushing the additives into the washer at predetermined times during a cycle of the washer, the liquid diverter having a main inlet for liquid to enter, a liquid outlet providing a plurality of exit paths for the liquid, and at least two control ports respectively coupled to ambient, the arrangement further including means responsive to the timer for selectively closing each of the control ports respectively from ambient at predetermined times for determining through which exit path and thereby into which dispenser compartment liquid entering the main inlet will emerge, and a chamber coupled respectively between each control port and its respective closing means for accumulating liquid emerging from the control ports, the chambers being dimensioned for preventing audible sonic oscillations in the liquid flow diversion arrangement, wherein the improvement comprises:

a hose associated respectively with each chamber for draining liquid accumulating therein, the hose being dimensioned to act as a closed valve with respect to the control port, while allowing liquid to drain automatically from the chamber when a sufficient head has been built up therein.

2. In the automatic washer of claim 1 wherein the liquid diverter is the transverse pressure differential type.

3. In the automatic washer of claim 1 wherein a ball check valve is associated with each control port respectively to help prevent the emergence of liquid from the control ports.

4. In the automatic washer of claim 1 wherein there is a pair of control ports and means coupling the ports respectively to ambient adjacent the timer.

5. In the automatic washer of claim 1 wherein each hose is coupled respectively with each chamber at the bottom thereof for draining liquid accumulating therein.

* * * * *